US010451261B2

(12) United States Patent
Liu et al.

(10) Patent No.: US 10,451,261 B2
(45) Date of Patent: Oct. 22, 2019

(54) SAFETY SWITCH END CAP FOR ILLUMINATING DEVICE AND ILLUMINATED DEVICE COMPRISING THE SAME

(71) Applicant: LEDVANCE GmbH, Garching (DE)

(72) Inventors: Jun Liu, Guangdong (CN); Shijun Nie, Guangdong (CN)

(73) Assignee: LEDVANCE GMBH, Garching Bei München (DE)

( * ) Notice: Subject to any disclaimer, the term of this patent is extended or adjusted under 35 U.S.C. 154(b) by 0 days.

(21) Appl. No.: 15/543,369

(22) PCT Filed: Nov. 10, 2015

(86) PCT No.: PCT/EP2015/076149
§ 371 (c)(1),
(2) Date: Jul. 13, 2017

(87) PCT Pub. No.: WO2016/113011
PCT Pub. Date: Jul. 21, 2016

(65) Prior Publication Data

US 2018/0031222 A1 Feb. 1, 2018

(30) Foreign Application Priority Data

Jan. 13, 2015 (CN) ..... 2015 1 0016727

(51) Int. Cl.
*F21K 9/272* (2016.01)
*H01R 13/703* (2006.01)
(Continued)

(52) U.S. Cl.
CPC ..... *F21V 25/04* (2013.01); *F21V 23/06* (2013.01); *H01H 13/023* (2013.01);
(Continued)

(58) Field of Classification Search
CPC ..... F21V 25/04; H01R 33/96; H01R 33/0836; H01R 33/08
See application file for complete search history.

(56) References Cited

U.S. PATENT DOCUMENTS 8,636,391 B2 * 1/2014 Dellian ..... H01R 33/96 362/217.01
8,847,475 B2 * 9/2014 Heil ..... F21V 25/04 174/140 R (Continued)

FOREIGN PATENT DOCUMENTS

DE 102012206188 A1 10/2013
DE 102012206190 A1 10/2013

(Continued)

*Primary Examiner* — Vanessa Girardi
(74) *Attorney, Agent, or Firm* — Hayes Soloway PC

(57) ABSTRACT

The present invention relates to an end cap (100) for an illuminating device and an illuminating device comprising the same, wherein the end cap comprises a housing (1) and a drive structure (2) partially arranged within the housing, wherein the drive structure is configured to drive an electric switch (3) arranged within the housing, wherein the drive structure (2) comprises a first drive part (21) exposed from a first surface of the housing and a second drive part (22) exposed from a second surface of the housing, wherein when the first drive part is located in a first position, the first drive part locks the second drive part, and when the first drive part is moved to a second position in a first direction, the first drive part unlocks the second drive part such that the second drive part can switch-on the electric switch upon the second drive part is moved in a second direction.

18 Claims, 5 Drawing Sheets

(51) Int. Cl.

| | |
|---|---|
| ***F21V 25/04*** | (2006.01) |
| ***F21V 23/06*** | (2006.01) |
| ***H01H 13/02*** | (2006.01) |
| ***H01H 13/04*** | (2006.01) |
| ***H01H 13/20*** | (2006.01) |

(52) U.S. Cl.
CPC ..... *H01H 13/04* (2013.01); *H01H 13/20* (2013.01); *H01R 13/703* (2013.01); *F21K 9/272* (2016.08); *H01H 2235/01* (2013.01)

(56) References Cited

U.S. PATENT DOCUMENTS

| | | | | |
|---|---|---|---|---|
| 9,923,325 | B2 * | 3/2018 | Jansen | F21V 25/04 |
| 2013/0127327 | A1 | 5/2013 | Heil et al. | |

FOREIGN PATENT DOCUMENTS

| | | | |
|---|---|---|---|
| EP | 2633227 | A2 | 9/2013 |
| WO | 2014115045 | A1 | 7/2014 |

* cited by examiner

SAFETY SWITCH END CAP FOR ILLUMINATING DEVICE AND ILLUMINATED DEVICE COMPRISING THE SAME

TECHNICAL FIELD

The present invention relates to an end cap for an illuminating device and an illuminating device comprising the end cap.

BACKGROUND ART

The end caps are often arranged at both ends of a generally used tubular light-emitting device for connection with the power supply. In order to improve the safety of the light-emitting device, the end caps usually will be designed with the two-step safety operation function. After the lamp tube installed with the end caps is manually connected to an adapter with a power supply and is secured, the end caps need to be further operated manually so as to switch on the electrical connection between the power supply and the lamp tube. The end cap used for a light emitting device in the prior art often uses, for instance, an electric, magnetic, or thermal switching means so as to switching on and off the electrical connection between the power supply and the lamp tube. In one of the prior art, for example, a mechanical switching means is used, which switching means can switch on or off the electrical connection between the power supply and the lamp tube when the end cap is rotated relative to the lamp tube. The above end caps put forward in the prior art usually need additional manual operation, after the end caps are completely installed and secured to the adapter, so as to turn on or off the light source connected to the end cap.

SUMMARY OF THE INVENTION

The present invention provides a novel end cap for an illuminating device and an illuminating device comprising this end cap. The end cap according to the present invention has a simple mechanical structure, and via simple operation to the end cap, it can realize that an electric switch is allowed to be switched on only after the end cap connected with the light source is installed onto an electric socket, and that the electric switch within the end cap is automatically switched off without additional manual operation when the end cap is taken out of the socket, thus ensuring the use safety of the illuminating device.

One of the objects of the present invention is realized via such an end cap for an illuminating device that comprises a housing and a drive structure partially arranged within the housing, wherein the drive structure is configured to drive an electric switch arranged within the housing, wherein the drive structure comprises a first drive part exposed from a first surface of the housing and a second drive part exposed from a second surface of the housing, wherein when the first drive part is located in a first position, the first drive part locks the second drive part, and when the first drive part is moved to a second position in a first direction, the first drive part unlocks the second drive part such that the second drive part can switch on the electric switch upon the second drive part is moved in a second direction.

According to the solution of the present invention, when the first drive part exposed from the first surface of the housing is in the first position, the electric switch within the housing is not switched on, nor the second drive part exposed from the second surface can operate the electric switch to switch on the same because the second drive part is locked in position by the first drive part. In other words, when the first drive part is in the first position, the second drive part cannot move, or to be more exact, the second drive part cannot be pressed or moved in the second direction, i.e. cannot be moved towards the interior of the housing. However, once the first drive part is driven by, for instance, an external force, to start to move from the first position, and once it is moved to the second position, the second drive part is unlocked at this point, and then, the second drive part is movable with the help of the external force, i.e. specifically, moved in the second direction towards the interior of the housing. Accordingly, after the second drive part is moved, the electric switch within the housing can be operated by the second drive part to switch on.

According to a preferred example of the present invention, the second drive part comprises a trigger and an actuator connected to the trigger, wherein in the first position, the trigger is capable of being separated from the actuator by the first drive part and locked, and in the second position, the trigger is movable relative to the first drive part so as to drive the actuator, such that the electric switch is switched on by means of movement of the actuator.

When the second drive part is in the first position, the trigger of the second drive part, hindered by the first drive part, cannot be moved towards the interior of the housing, or to be more exact, towards the actuator, so as to be close to the actuator. However, once the first drive part is moved to the second position, the first drive part is unlocked, that is, at this point, the trigger of the second drive part is movable relative to the actuator, and gets close to the actuator under the effect of the external force, thereby coming into contact with the actuator. When the trigger is in contact with the actuator, under the effect of further external force, the trigger can move the actuator.

Further preferably, the first drive part comprises first stop parts, wherein in the first position, the first stop parts separate free ends of the trigger from corresponding free ends of the actuator, and in the second position, the free ends of the trigger are movable over the first stop parts to come into contact with corresponding free ends of the actuator. The first stop parts are preferably configured to be formed by the free ends of the first drive part. Thus, in the first position, when the first drive part is not moved yet, the first stop parts are located between the trigger and the actuator of the second drive part, thereby the trigger can no longer get close to the actuator or come into contact with the actuator.

Preferably, the first drive part comprises second stop parts, wherein after the actuator is moved by the trigger, the actuator can be held by the second stop parts and switching on the electric switch. After the first drive part leaves the first position and enters the second position, the first stop parts do not have any effect on the trigger or the actuator of the second drive part any more, i.e. cannot separate them. Subsequently, when the actuator is further moved by the trigger, the trigger can move the actuator to the positions of the second stop parts such that the actuator can be held in position by the second stop parts, i.e. at this time, even if it does not continue to apply a force on the trigger, the actuator still can be held by the second stop parts, without movement relative to the first drive part. Besides, as moved by the trigger, the actuator can be moved on the electric switch in relation to the electric switch so as to operate the electric switch for switching on or off the electric switch.

Advantageously for the present invention, the first drive part comprises recesses, wherein when the first drive part is moved in the first direction, the actuator can enter or leaving the recesses, and when the actuator is located in the recesses, the trigger can force the actuator out of the recesses in the second direction. When the actuator is located in the recesses, even without the effect of the trigger, the actuator still can be held in the recesses, but will not escape from the recesses. However, with the further operation of the trigger, the parts of the actuator entering into the recesses can escape from the recesses, i.e. forced out of the recesses by the trigger, and thus no longer located in the recesses.

Further preferably, the recesses are configured to be adjacent the second stop parts, respectively. In cases where the recesses are adjacent the second stop parts, once the trigger forces the parts of the actuator located in the recesses out of the recesses, the parts can immediately further interact with the second stop parts so as to be held by the second stop parts.

Preferably, along with the first drive part moving from the second position to the first position, the actuator becomes to abut against the first stop parts from abutting against the second stop parts. When the first drive part is restored from the second position to the first position in the first direction, the actuator at the same time is also movable on the first drive part in relation to the first drive part, such that the actuator is changed from a state of being stopped by the second stop parts to a state of being stopped by the first stop parts. Besides, correspondingly, when the first drive part is moved from the first position to the second position, under the effect of the trigger, the actuator is changed from a state of being stopped by the first stop parts to a state of being stopped by the second stop parts.

According a preferred example of the present invention, a position of the trigger can be reset automatically upon the electric switch is switched on by the actuator. Elastic components, such as springs, are preferably arranged between the trigger and the actuator. In this way, after the actuator is held by the second stop parts of the first drive part, the trigger can be reset, by means of the elastic resilience of the elastic components, to a position before it is moved by an external force in the second direction towards the interior of the housing, i.e. if the trigger is pressed into the housing, the trigger can restore the state of being exposed from the housing by means of the elastic components.

Further preferably, the actuator is configured such that it can indicate the switching states of the electric switch outside the housing by means of the trigger. Thus, the user can observe from the outside of the housing whether the electric switch located within the housing is already switched on or in a state of being switched off.

According to a preferred example of the present invention, the actuator is inserted into the trigger and one of the free ends of the actuator is visible from outside of the housing through the trigger. The relative position of the actuator within the housing can be known from the part of the actuator exposed from the trigger, that is, whether it is in a position where the electric switch is switched off or in a position where the electric switch has been switched on, therefore, the part of the actuator exposed from the trigger can be regarded as an indicator of the state of the electric switch.

Further preferably, the trigger comprises two first legs, and the actuator comprises two second legs corresponding in position to the first legs, respectively, such that in the first position, the first legs are separated from the second legs, respectively, by means of the first drive part, and in the second position, the second legs can come into contact with the first legs, respectively. When the first drive part is located in the first position, the first drive part can separate the two legs of the trigger from the legs of the actuators simultaneously.

Preferably, in the first position, the first drive part is exposed from the housing, and in the second position, the first drive part is completely hidden in the housing. With this design, when for instance the first drive part of the end cap according to the present invention is pressed by an electric socket into the housing as it is inserted into the electric socket, the first drive part is moved from the first position to the second position.

The other object of the present invention is realized via such an illuminating device that comprises the end cap as described above. The illuminating device according to the present invention comprises the end cap having a simple mechanical structure, wherein the end cap provides the possibility that the electric switch within the housing of the end cap is allowed to be switched on after the end cap is installed to the electric socket. Thus, the illuminating device according to the present invention has the electrical connection with improved safety.

BRIEF DESCRIPTION OF THE DRAWINGS

The accompanying drawings constitute a part of the present Description and are used to provide further understanding of the present invention. Such accompanying drawings illustrate the embodiments of the present invention and are used to describe the principles of the present invention together with the Description. In the accompanying drawings the same components are represented by the same reference numbers. As shown in the drawings.

DETAILED DESCRIPTION OF THE EMBODIMENTS

Figure 1:
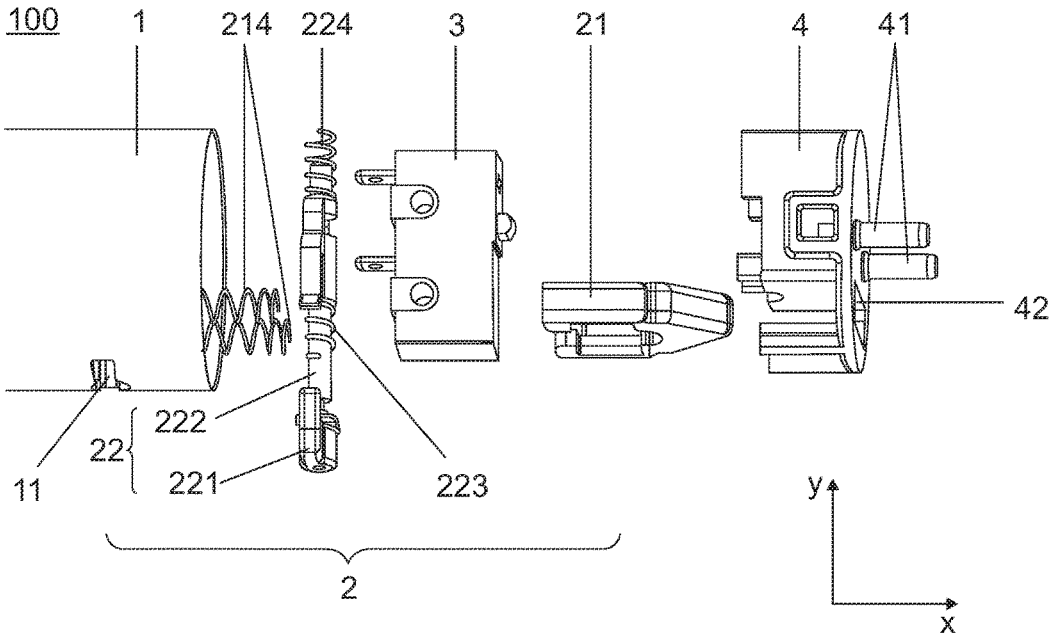
FIG. 1 shows an exploded view of an end cap according to the present invention.

FIG. 1 shows an exploded view of an end cap 100 according to the present invention. The end cap 100 according to the present invention comprises a housing 1, and an electric switch 3 arranged within the housing 1, a drive structure 2 for driving control of this electric switch 3. The drive structure 2 is partially arranged within the housing 1 and exposed to the outside of the housing 1. The end cap 100 further comprises an electric plug 4 with electric pins 41, and the electric plug 4 can enclose the electric switch 3 within the housing 1 at an opening end of the housing 1.

The drive structure 2 of the end cap 100 according to the present invention comprises a first drive part 21 and a second drive part 22. The first drive part 21 is designed in a clip shape, i.e. it has two legs. A top end of the first drive part 21 is capable of extending out from a first opening arranged at one end face of the electric plug 4 mounted with the electric pins 41, such that the first drive part 21 can be operated outside the electric plug 4 or outside the housing 1. When the second drive part 22 is installed within the housing 1, a top end of the second drive part 22 is capable of extending out from a second opening 11 arranged on a side surface of the housing 1, such that the second drive part 22 can be operated outside the housing 1.

According to an example of the present invention, the first drive part 21 is movable in a first direction, i.e. a transverse direction (axis x direction). The first drive part 21 is movable in the axis x direction from a first position to a second position.

Besides, the second drive part 22 is movable in a second direction, i.e. in a longitudinal direction (axis y direction) relative to the above-mentioned transverse direction. The second drive part 22 is movable in the axis y direction relative to the first drive part 21 or to the housing 1, i.e. towards or away from the interior of the housing 1.

As shown in FIG. 1, the end cap 100 further comprises a first, a second, and a third elastic components 214, 223, 224 arranged within the housing 1. Under the effect of an external force, the first drive part 21 can move by resisting the first elastic component 214 arranged to be connected with the first drive part 21, such that the first drive part 21 can automatically return from the second position to the first position under the effect of an elastic resilience of the first elastic component 214.

Besides, the second drive part 22 comprises a trigger 221 exposed partially from the housing 1 when installed in the housing 1 and a actuator 222 connected with the trigger 221. The actuator 222 of the second drive part 22 is arranged with the second elastic component 223 and the third elastic component 224. Both ends of the second elastic component 223 are connected to the trigger 221 and the actuator 222, respectively, thereby, the trigger 221 is capable of moving relative to the actuator 222 in a way of resisting an elastic force of the second elastic component 223. The third elastic component 224 has one end connected to the actuator 222 and the other end against the housing 1, thus, the actuator 222 can move resiliently relative to the housing 1 or to the first drive part 21 against an inner wall of the housing 1 under the effect of the trigger 221.

Figure 2:
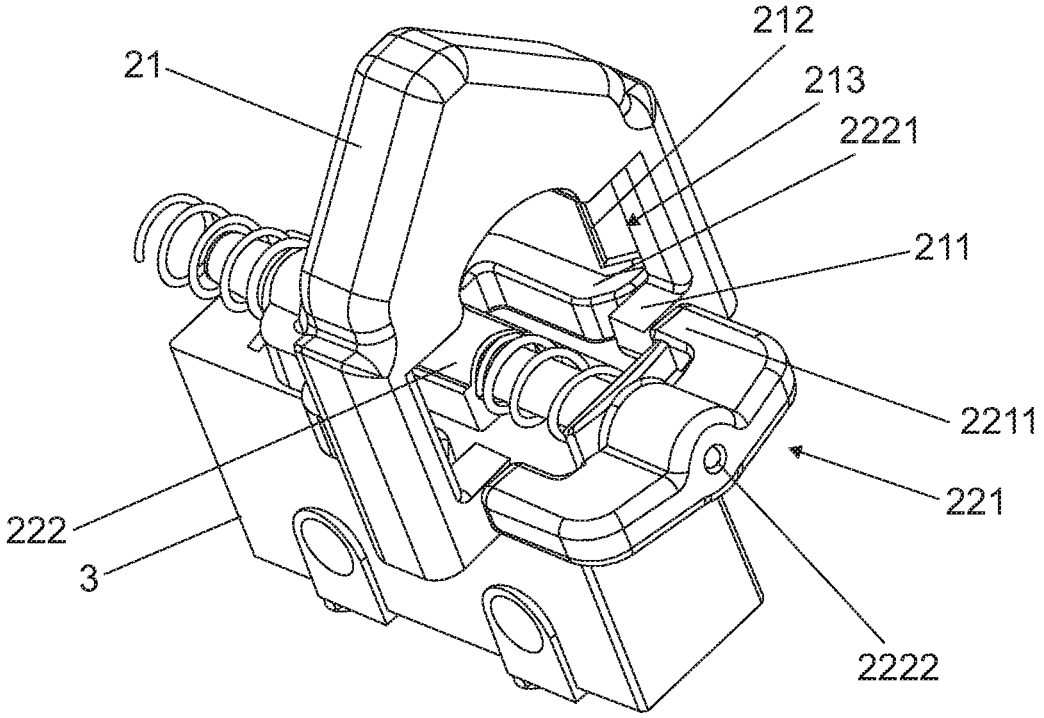
FIG. 2 shows a 3D side view of the end cap according to the present invention, wherein a first drive part of the end cap is located in a first position.
Figure 3:
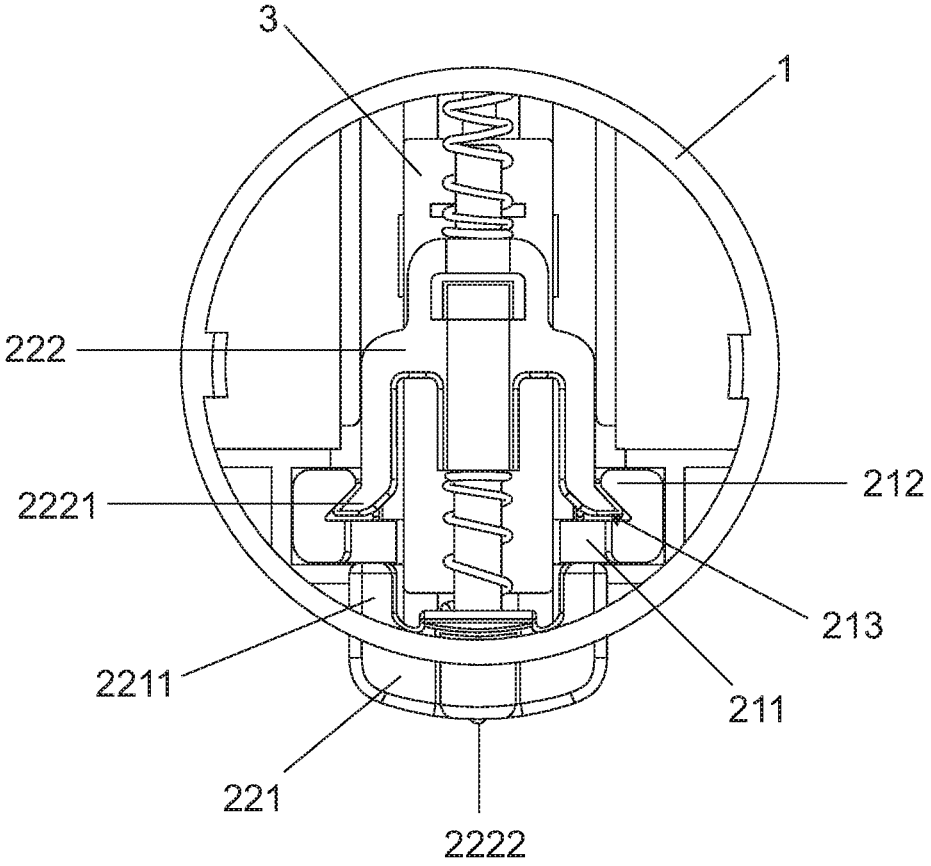
FIG. 3 shows a top cross-section view of the end cap according to the present invention, wherein the first drive part of the end cap is located in the first position.

FIG. 2 shows a 3D side view of the end cap 100 according to the present invention, wherein the first drive part 21 of the end cap 100 is located in a first position, and FIG. 3 shows a top cross-section view of the end cap 100 according to the present invention, wherein the first drive part 21 of the end cap 100 is located in the first position. The drive structure 2 can be arranged e.g. on one end face of the electric switch 3. In this way, two legs of the first drive part 21 can cross over the electric switch 3. Consequently, the two legs of the first drive part 21 can move relative to two lateral surfaces of the electric switch 3.

In the first position, when the first drive part 21 does not move under the effect of an external force, first stop parts 211 of the first drive part 21 separate two first legs 2211 of the trigger 221 of the second drive part 22 from two second legs 2221 of the actuator 222 of the second drive part 22. At this point, the first legs 2211 abut against first surfaces of the first stop parts 211, respectively, and the second legs 2221 abut against second surfaces of the first stop parts 211 opposite to the first surfaces, respectively.

As shown in FIG. 2 and FIG. 3, in the first position, the two second legs 2221 of the actuator 222 abut against the first stop parts 211, respectively, rather than against second stop parts 212 of the first drive part 21 or in recesses 213 of the first drive part 21. In this first position, the trigger 221 is exposed from the housing 1, and the trigger 221 is locked by the first drive part 21 and cannot move relative to the first drive part 21 or to the actuator 222.

Figure 4:
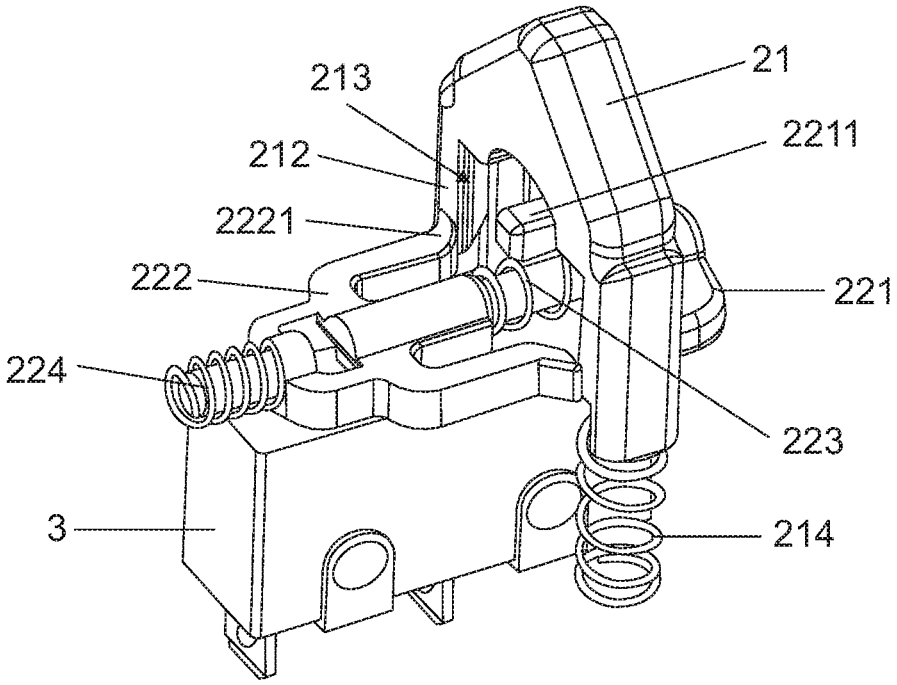
FIG. 4 shows a 3D side view of the end cap according to the present invention, wherein the first drive part of the end cap is located in a second position.
Figure 5:
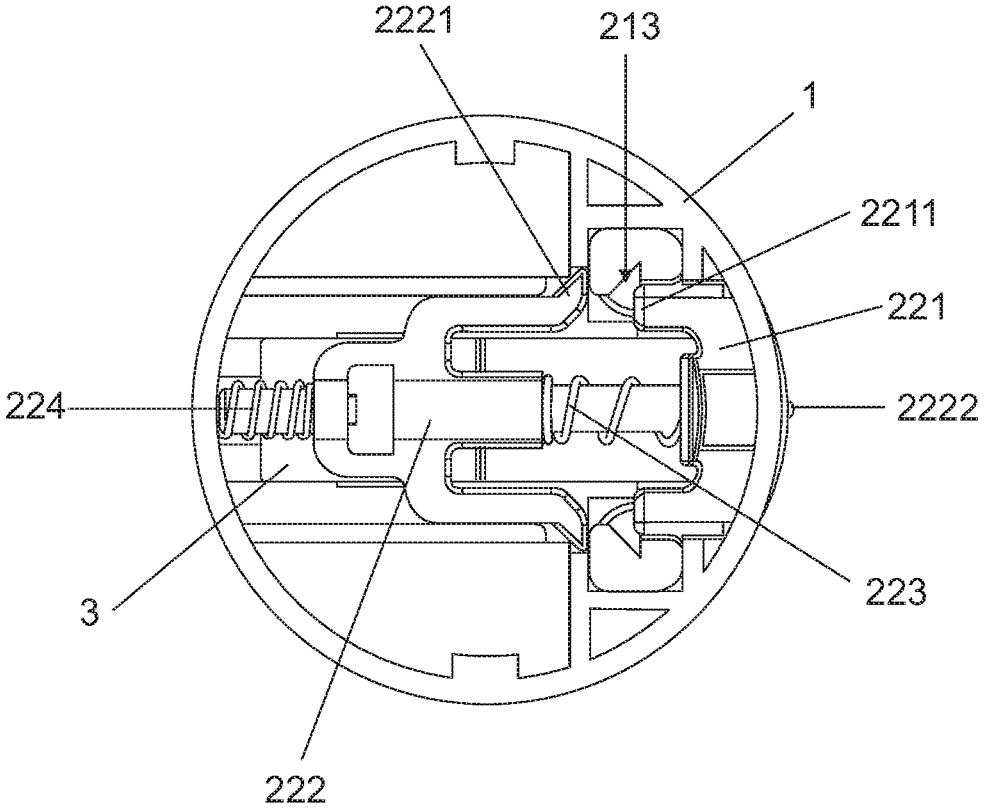
FIG. 5 shows a top cross-section view of the end cap according to the present invention, wherein the first drive part of the end cap is located in the second position.

FIG. 4 shows a 3D side view of the end cap 100 according to the present invention, wherein the first drive part 21 of the end cap 100 is located in a second position; and FIG. 5 shows a top cross-section view of the end cap 100 according to the present invention, wherein the first drive part 21 of the end cap 100 is located in the second position. When the first drive part 21 is under the effect of an external force, for instance, when the end cap 100 is installed to the electric socket, the first drive part 21 is movable from the first position to the second position due to the external force applied by the electric socket to the top end of the first drive part 21.

In the course that the first drive part 21 is moved from the first position to the second position, the two second legs 2221 of the actuator 21 can enter into the recesses 213 of the first drive part 21, respectively. At this point, the top cross-section view of the end cap 100 according to the present invention is similar to the cross-section view as shown in FIG. 3. However, different from the state as shown in FIG. 3, the trigger 221 is unlocked and movable relative to the first drive part 21, i.e. above and across the first stop 211 to come into contact with the actuator 222. Thereby, the two first legs 2211 of the trigger 221 can be in contact with the two second legs 2221 of the actuator 222, respectively.

When it continues to apply the external force on the trigger 221, the first legs 2211 of the trigger 221 can force the second legs 2221 of the actuator 222 in the recesses 213 out of the recesses 213, that is, enable the second legs 2221 to move from the recesses 213 onto the second stop parts 212. Thereafter, the two second legs 2221 of the actuator 222 abut against the second stop parts 212 and are held by the second stop parts 212, respectively. Under the effect of the trigger 221, the actuator 222 is movable relative to the electric switch 3 above the electric switch 3, and can for instance drive a plug on the electric switch 3 to switch on the electric switch 3, so as to turn on the electrical connection of the electric socket to the light source of the illuminating device via the electric switch.

Besides, as shown in FIG. 5, and as can be observed from FIG. 2 and FIG. 3, since the actuator 222 is connected with the trigger 221 in a way of being inserted into the trigger 221, a top end 2222 of the actuator 222 can be exposed outside the housing 1 via the trigger 221, that is, a user can see the top end 2222 of the actuator 222 from the outside of the trigger 221 or the housing 1.

According to the design of the top end 2222, when the actuator 222 is not moved to be held by the second stop parts 212, the top end 2222 can be seen via the trigger 221. However, after the actuator 222 is moved by the trigger 222 such that the actuator 222 is held by the second stop parts 212 and switches on the electric switch 3, the trigger 221 will be reset in position by means of the second elastic component 223. Before the trigger 221 is reset, the user still can see the top end 2222 of the actuator 222 exposed from the trigger 221 via the trigger 221. After the trigger 221 is reset, the top end 2222 is moved to the interior of the trigger 221 relative to the trigger 221, and then the user cannot see the top end 2222 via the trigger 221 any longer. As a result, the top end 2222 can be regarded as an indicator of the on and off states of the electric switch 3, and the user, depending on whether he can see the top end 2222 of the actuator 222 via the trigger 221, can determine whether the electric switch 3 is switched on by the actuator 222. The top end 2222 can be designed to be coated with a color different from that of the housing 1 or of the drive structure 2 for distinction from the other parts and easy identification by the user.

The above is merely preferred embodiments of the present invention but not to limit the present invention. For the person skilled in the art, the present invention may have various alterations and changes. Any alterations, equivalent substitutions, improvements, within the spirit and principle of the present invention, should be covered in the protection scope of the present invention.

REFERENCE SIGNS

1 housing
2 drive structure
3 electric switch
4 electric plug
41 electric pin
42 opening on first surface
11 opening on second surface
21 first drive part
22 second drive part
221 trigger
222 actuator
211 first stop
212 second stop
213 recess
214 first elastic component
223 second elastic component
224 third elastic component
2211 first leg
2221 second leg
2222 top end of actuator, indicator of on and off states
100 end cap.

What is claimed is:

1. An end cap for an illuminating device, the end cap comprising:

a housing; and a drive structure partially arranged within the housing, wherein the drive structure is configured to drive an electric switch arranged within the housing, characterized in that the drive structure comprises:

a first drive part exposed from a first surface of the housing, characterized in that the first drive part comprises first stop parts and second stop parts; and a second drive part exposed from a second surface of the housing, characterized in that the second drive part comprises a trigger and an actuator connected to the trigger;

wherein when the first drive part is located in a first position, the first drive part locks the second drive part such that the second drive part cannot move relative to the first drive part, and when the first drive part is moved to a second position in a first direction, the first drive part unlocks the second drive part such that the second drive part can switch-on the electric switch upon the second drive part being moved in a second direction;

wherein in the first position, the trigger can be separated from the actuator by the first drive part and locked, and in the second position, the trigger is movable relative to the first drive part so as to drive the actuator, such that the electric switch is switched on by means of the movement of the actuator;

wherein in the first position, the first stop parts separate free ends of the trigger from corresponding free ends of the actuator, and in the second position, the free ends of the trigger are movable over the first stop parts to come into contact with the corresponding free ends of the actuator; and wherein after the actuator is moved by the trigger, the actuator can be held by the second stop parts and switch-on the electric switch; and further characterized in that along with the first drive part moving from the second position to the first position, the actuator moves from abutting against the second stop parts to abutting against the first stop parts.

2. The end cap according to claim 1, characterized in that the position of the trigger is automatically resettable upon the electric switch being switched on by the actuator.

3. The end cap according to claim 1, characterized in that the trigger comprises two first legs, and the actuator comprises two second legs corresponding in position to the first legs, respectively, such that in the first position, the first legs are separated from the second legs, respectively, by means of the first drive part, and in the second position, the second legs can come into contact with the first legs, respectively.

4. The end cap according to claim 1, characterized in that in the first position, the first drive part is exposed from the housing, and in the second position, the first drive part is completely hidden in the housing.

5. An illuminating device, characterized in that the illuminating device comprises the end cap according to claim 1.

6. The end cap according to claim 1, characterized in that the first drive part further comprises recesses, wherein when the first drive part is moved in the first direction, the actuator can enter or leave the recesses, and when the actuator is located in the recesses, the trigger can force the actuator out of the recesses in the second direction.

7. The end cap according to claim 6, characterized in that the recesses are configured to be adjacent the second stop parts, respectively.

8. The end cap according to claim 1, characterized in that the actuator is configured such that it can indicate switching states of the electric switch from the outside of the housing by means of the trigger.

9. The end cap according to claim 8, characterized in that the actuator is inserted into the trigger and one of the free ends of the actuator is visible from outside of the housing through the trigger.

10. An end cap for an illuminating device, the end cap comprising:

a housing; and a drive structure partially arranged within the housing, wherein the drive structure is configured to drive an electric switch arranged within the housing, characterized in that the drive structure comprises:

a first drive part exposed from a first surface of the housing; and a second drive part exposed from a second surface of the housing, characterized in that the second drive part comprises a trigger and an actuator connected to the trigger, characterized in that the actuator is configured such that it can indicate switching states of the electric switch from the outside of the housing by means of the trigger, characterized in that the actuator is inserted into the trigger and one of the free ends of the actuator is visible from outside of the housing through the trigger;

wherein when the first drive part is located in a first position, the first drive part locks the second drive part such that the second drive part cannot move relative to the first drive part, and when the first drive part is moved to a second position in a first direction, the first drive part unlocks the second drive part such that the second drive part can switch-on the electric switch upon the second drive part being moved in a second direction; and wherein in the first position, the trigger can be separated from the actuator by the first drive part and locked, and in the second position, the trigger is movable relative to the first drive part so as to drive the actuator, such that the electric switch is switched on by means of the movement of the actuator.

11. The end cap according to claim 10, characterized in that the position of the trigger is automatically resettable upon the electric switch being switched on by the actuator.

12. The end cap according to claim 10, characterized in that the trigger comprises two first legs, and the actuator comprises two second legs corresponding in position to the first legs, respectively, such that in the first position, the first legs are separated from the second legs, respectively, by means of the first drive part, and in the second position, the second legs can come into contact with the first legs, respectively.

13. The end cap according to claim 10, characterized in that in the first position, the first drive part is exposed from the housing, and in the second position, the first drive part is completely hidden in the housing.

14. An illuminating device, characterized in that the illuminating device comprises the end cap according to claim 10.

15. The end cap according to claim 10, characterized in that the first drive part comprises first stop parts, wherein in the first position, the first stop parts separate the free ends of the trigger from the corresponding free ends of the actuator, and in the second position, the free ends of the trigger are movable over the first stop parts to come into contact with the corresponding free ends of the actuator.

16. The end cap according to claim 15, characterized in that the first drive part further comprises second stop parts, wherein after the actuator is moved by the trigger, the actuator can be held by the second stop parts and switch-on the electric switch.

17. The end cap according to claim 16, characterized in that the first drive part further comprises recesses, wherein when the first drive part is moved in the first direction, the actuator can enter or leave the recesses, and when the actuator is located in the recesses, the trigger can force the actuator out of the recesses in the second direction.

18. The end cap according to claim 17, characterized in that the recesses are configured to be adjacent the second stop parts, respectively.

* * * * *